US005310250A

United States Patent [19]

Gonsior

[11] Patent Number: 5,310,250

[45] Date of Patent: May 10, 1994

[54] IN-LINE SKATE WHEELS

[76] Inventor: Stanley W. Gonsior, 14424 Lennell Dr., Minnetonka, Minn. 55345

[21] Appl. No.: 62,312

[22] Filed: May 14, 1993

[51] Int. Cl.[5] ..... B60B 5/02

[52] U.S. Cl. ..... 301/5.3; 280/11.23

[58] Field of Search ..... 301/5.3, 5.7; 280/11.2, 280/11.22, 11.23, 11.25

[56] References Cited

U.S. PATENT DOCUMENTS 5,129,709 7/1992 Klamer ..... 301/5.3
5,171,032 12/1992 Dettmer ..... 280/11.22 X
5,192,088 3/1993 Yu ..... 280/11.23 X

OTHER PUBLICATIONS

Rollerblade, Inc. *The Official Rollerblade® Handbook*, 1992, p. 21.

Rollerblade, Inc., *Rollerblade® Fall 1991 Catalog*, 1991, pp. 1 & 3.

*Primary Examiner*—Russell D. Stormer

*Attorney, Agent, or Firm*—Amy J. Hoffman; Harold D. Jastram; Robert A. Elwell

[57] ABSTRACT

An in-line skate wheel is disclosed including a radially symmetrical body where the body is defined by the following: An axial bore surface, a first convex arcuate perimeter surface subsuming less than a 180 degree angle and having a first edge and a second edge wherein the first arcuate perimeter surface is radially disposed concentric to the axial bore. At least one first convex transitional arcuate surface having greater radii than the first arcuate perimeter surface and tangentially connecting to the perimeter surface at the first edge and radially disposed to the axial bore. At least one second convex transitional arcuate surface having greater radii than the first arcuate perimeter surface tangentially connecting to the perimeter surface at the second edge and radially symmetrically disposed relative to the axial bore. A pair of spaced apart parallel sidewalls normal to the axial bore connect the transitional arcuate surfaces to the axial bore surface and are radially symmetrically disposed relative to the axial bore.

12 Claims, 4 Drawing Sheets

IN-LINE SKATE WHEELS

FIELD OF THE INVENTION

The present invention relates to skate wheels and particularly relates to in-line skate wheels. More specifically, the invention relates to the shape of in-line skate wheels.

BACKGROUND OF THE INVENTION

With the advent of the of in-line skating in the early 1980's in-line skating has increased in popularity to a point that it is successfully competing and coexisting with traditional roller skating. The popularity of in-line skating has increased since its inception to a point that nearly a worldwide market now purchases in-line skates. With the increased popularity, skaters have become quite sophisticated and demand state of the art equipment. To meet the consumer's demands for lighter, faster skates, in-line skate manufacturers are continually striving to develop new skates.

Wheels of in-line skates are the subject of constant research and development. Early in-line skate wheels were manufactured out of high friction material which created prohibitively slow wheels. The industry quickly started producing the wheels from materials which had a lower coefficient of friction and thereby created faster wheels.

Although the early in-line skate wheels were slower than currently sold wheels, in-line skates were always faster than traditional roller skates. Without intending to be bound by theory it is believed that the speed of the in-line skates is in part attributed to wheel shape and to wheel mounting. The wheels of in-line skates have traditionally been hemispherical in shape. When coasting on traditional roller skates and on in-line skates, the wheels are without camber. In-line skates have a smaller surface area contacting the pavement as compared to traditional roller skates during coasting because the wheels of traditional roller skates are much wider and flatter than the wheels of in-line skates. Since in-line skates have a much smaller area contacting the pavement, the amount of friction between the wheel surface and the pavement is thereby reduced as compared to traditional roller skates.

In-line skates are distinct from traditional roller skates in manners other than mere wheel shape. The wheel attachment is very different on the two skate types. Wheels of traditional skates are pivotally mounted by "trucks" to the skate shoe. Pivotal mounting allows the wheel axes to remain substantially parallel to the ground at substantially all times. As a skater accelerates by laterally pushing the skate against the grc ınd away from the skater's body, the pivoting wheel axes allow the wheel to remain substantially upright. Thus, in traditional roller skates the portion of the wheel which contacts the pavement remains substantially constant.

Compare this to in-line skates which have wheels rigidly mounted to the skate shoe. As an in-line skater pushes his skate laterally against the ground to accelerate, the wheel axes become inclined relative to the ground causing the wheels to tilt or camber relative to the ground or pavement. Therefore, the wheel portion which contacts the pavement is not constant. The wheel shapes which provide optimal performance on in-line skates as compared to traditional roller skates are very different due to the above-described differences with wheel mounting.

As previously mentioned, the surface of the in-line skate wheel has traditionally been a hemispherical shape. This shape has functioned well to date, however, a wheel shape which is functional on in-line skates and also increases the speed of the skater without increasing the effort would provide a desirable improvement over the existing art.

SUMMARY

The present invention provides a particular shape of wheel well-suited for in-line skates. The wheel of the invention enables the in-line skater to increase his/her speed without increasing his/her effort. Thus, the wheels of the present invention provide an advance in efficiency for in-line skaters.

Generally, the wheel of the present invention has a round side view having an axial bore therethrough. A pair of parallel sidewalls normal to the axial bore extend from the axial bore. At least one first convex transitional arcuate surface extends from one of the sidewalls. At least one second convex transitional arcuate surface extends from the second sidewall. A first convex arcuate surface joins the first and second transitional arcuate surfaces to form a smooth periphery of the wheel. The first convex arcuate surface subsumes less than a 180° angle or less than a hemisphere and a radii less than one half the radii of the transitional arcuate surfaces.

An in-line skate wheel is disclosed including a radially symmetrical body where the body is defined by the following. An axial bore surface, a first convex arcuate perimeter surface subsuming less than a 180 degree angle and having a first edge and a second edge wherein the first arcuate perimeter surface is radially disposed concentric to the axial bore. At least one first convex transitional arcuate surface having greater radii than the first arcuate perimeter surface and tangentially connecting to the perimeter surface at the first edge and radially disposed to the axial bore. At least one second convex transitional arcuate surface having greater radii than the first arcuate perimeter surface tangentially connecting to the perimeter surface at the second edge and radially symmetrically disposed relative to the axial bore. A pair of spaced apart parallel sidewalls normal to the axial bore connect the transitional arcuate surfaces to the axial bore surface and are radially symmetrically disposed relative to the axial bore.

DETAILED DESCRIPTION

Figure 10:
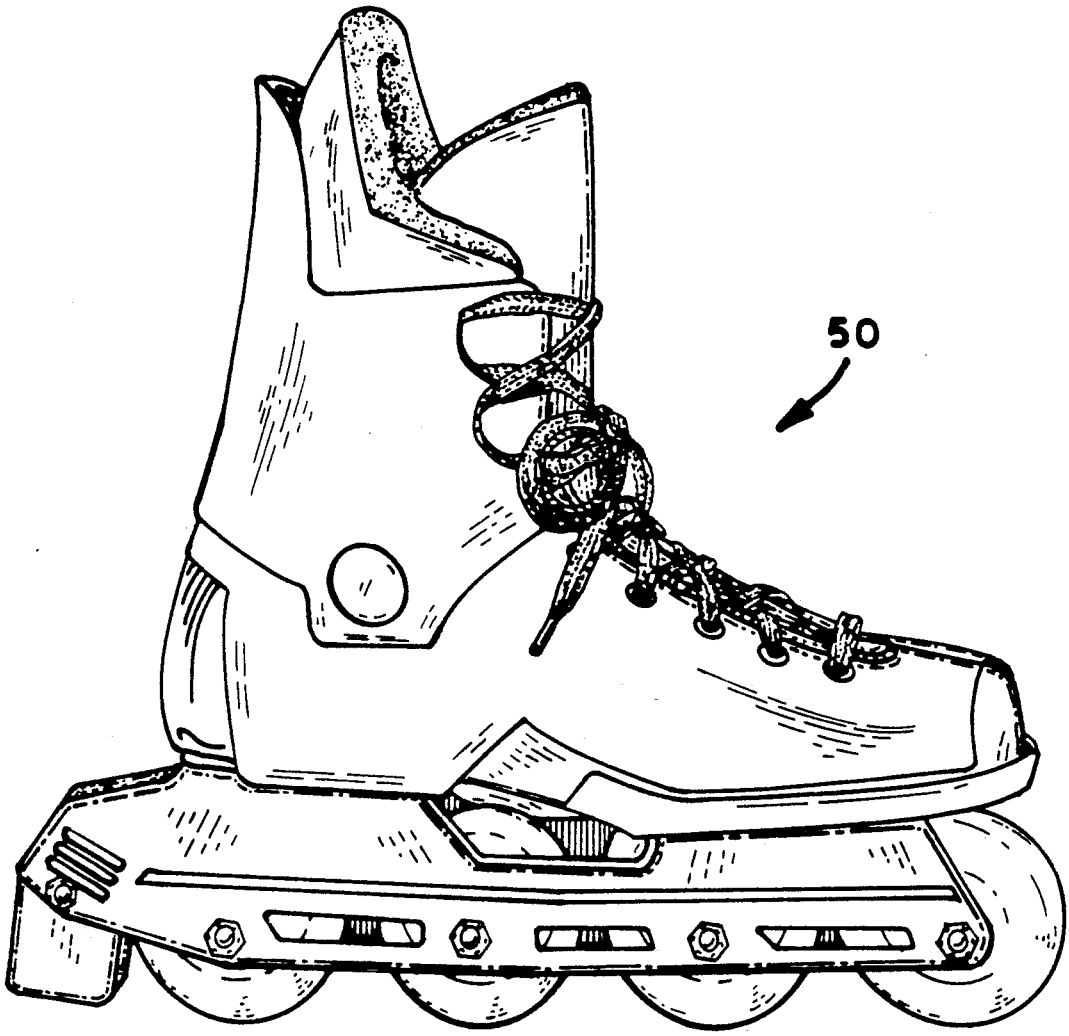
FIG. 10 is a side elevational view of an in-line skate including wheels of the present invention.

A substantially solid in-line skate wheel having an axial bore therethrough is shown generally as 18 in FIGS. 1 through 5. An in-line skate wheel 18 generally has two distinct structural components which include a wheel tread 20 or wheel body 20 and a hub 24. In order to use such a wheel 18 on in-line skates as shown in FIG. 10, the wheel 18 must contain the hub 24 in the axial bore 26.

Figure 1:
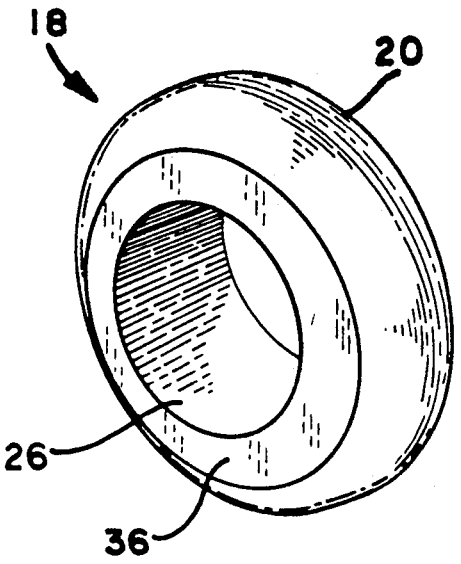
FIG. 1 is an isometric view of the in-line skate wheel of the present invention.
Figure 2:
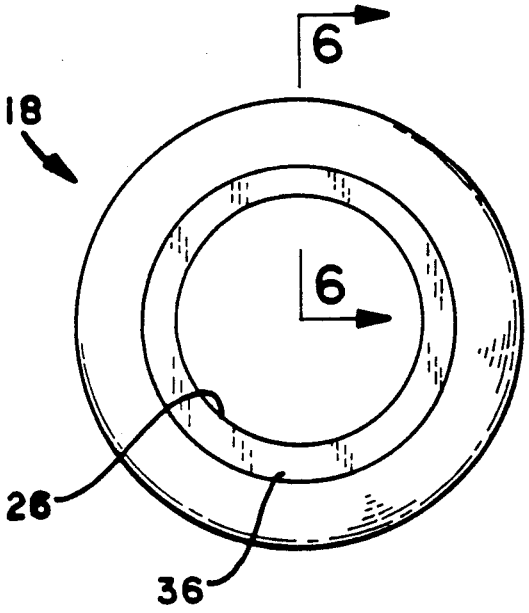
FIG. 2 is a front elevational view thereof.
Figure 3:
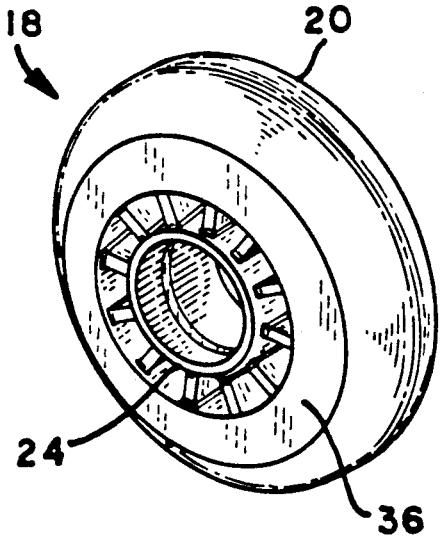
FIG. 3 is an isometric view of the wheel of the present invention having a spoked hub in the axial bore.
Figure 4:
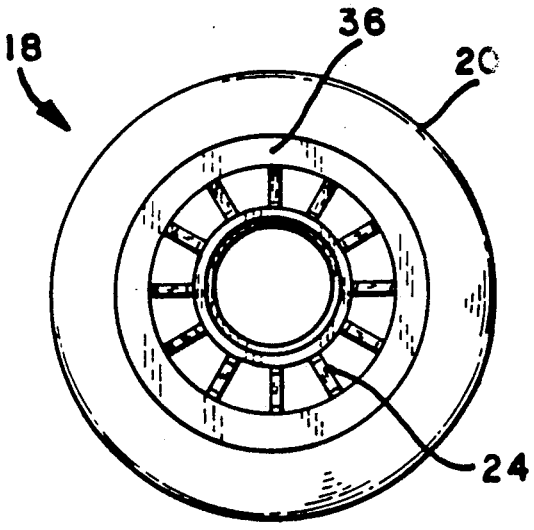
FIG. 4 is a front elevational view thereof.
Figure 5:
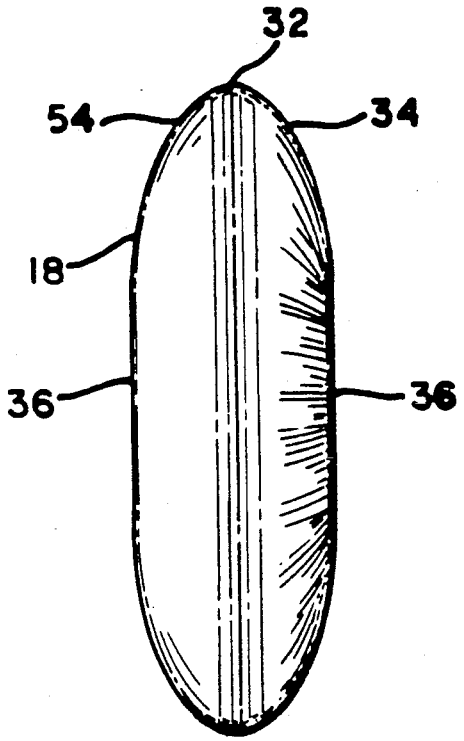
FIG. 5 is an end elevational view thereof.

FIGS. 3 and 4 show a wheel 18 containing spoked hub 24 in the axial bore 26. Hub 24 is a spoked hub, however, one skilled in the art will recognize that the specific design of the hub is not absolutely critical and any one of many variant hub designs may be used in the wheel 1 of the present invention including but not limited to a spoked hub 24.

Figure 7:
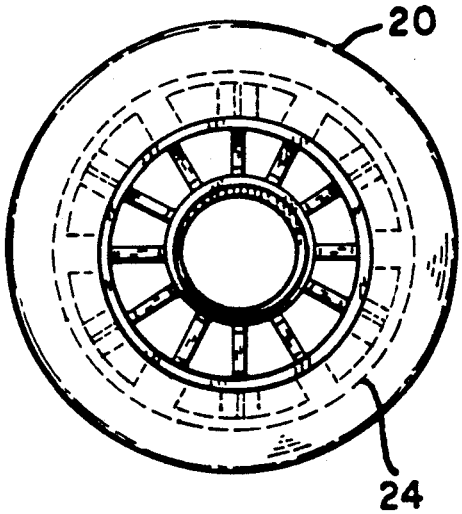
FIG. 7 is a front elevational view of the wheel of the present invention with a spoked hub in the axial bore and dashed lines showing the outer portion of the hub obscured by the tread portion of the wheel.
Figure 8:
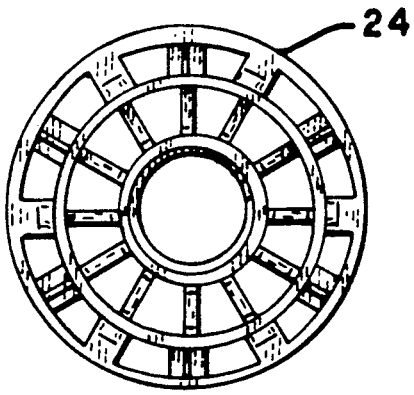
FIG. 8 is a side elevational view of an exposed hub of an in-line skate.
Figure 9:
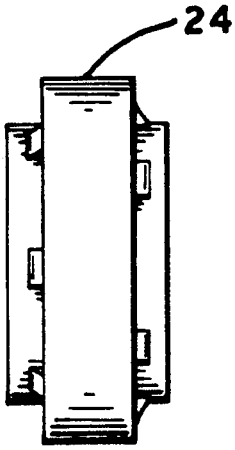
FIG. 9 is a side elevational view of an in-line skate including the wheels of the present invention.

For purposes of facilitating description, a hub 24 is shown in FIGS. 8 and 9 separate from the wheel 18. The wheel 18 is commonly molded around the hub 24 to Obtain a complete wheel 18 as shown in FIGS. 3 and 4. Any type of molding including cast or pour molding is used to produce in-line skate wheels. FIG. 7 shows the tread 20 surrounding the hub 24 of a complete wheel 18. Dashed lines depict that portion of the hub 24 which is obscured from view by the tread 20 of a complete wheel 18.

Figure 6:
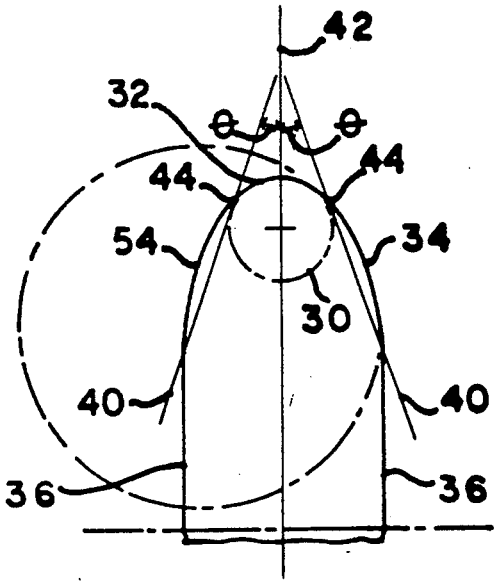
FIG. 6 is a cross section of the wheel of the present invention taken along line 6—6 of FIG. 1 further including dashed and solid lines for descriptive purposes.

The shape of the tread 20 is critical to the present invention. As shown in FIGS. 1 through 4, the tread 20 and hub 24 is a radially symmetrical body. FIG. 6 shows a portion of the cross section of the wheel of the present invention taken along line 6—6 of FIG. 2. The dashed lines show circles containing arcs which arcs together define the shape of the outer most regions of tread 20. The smaller circle 30 defines the first convex arcuate surface 32 at the periphery of the wheel tread 18. The first arcuate perimeter surface 32 contacts the pavement when a skater is coasting and the wheel is without camber and the axis is therefore substantially parallel to the pavement. Small circle 30 preferably has a radius of about 0.28 to about 0.36 inches, preferably about 0.32 inches. As viewed in cross section, such as in FIG. 6, the first arcuate perimeter surface 32 never extends to form a hemisphere. In other words, from tangential connection first edge 44 to tangential connection second edge 44 the arc does not subsume a 180° angle, but rather subsumes about 72° to about 79°. The first arcuate perimeter surface 32 is radially disposed concentric to the axial bore 26.

The extent of the first arcuate perimeter surface 32 is defined by the shortest distance along the small circle 30 between points of tangency 44. In order to locate the points of tangency 44, a line 42 is drawn through the center of small circle 30. Tangent lines 40 are drawn from a point along line 42 to a point of tangency 44 on small circle 30 where angles $\Theta$ are about 37.5 to about 39 degrees, preferably about 38.5 degrees.

First and second convex transitional arcuate surfaces 34 and 54 extend from each end of the first arcuate perimeter surface 32 and are tangent where they meet the peripheral surface 32. The transitional arcuate surfaces 34 and 54 are radially disposed concentric to the axial bore 26. As shown in FIG. 6, the transitional arcuate surfaces 34 and 54 have larger radii than the radius of the first arcuate surface 32. The radii of the transitional arcuate surfaces 34 and 54 are each at least 2.5 times greater than the radius of the first perimeter arcuate surface 32. Preferably, the radii of the transitional arcuate surfaces 34 and 54 are about 0.84 to about 0.92 inches, most preferably about 0.88 inches. The radii and length of the first and second convex transitional arcuate surfaces 34 and 54 may be either identical or different. If the radii and length are identical the transitional arcuate surfaces 34 and 54 are mirror images of each other. In other words, bilateral symmetry is present with respect to a plane perpendicular to the axial bore if subsequently described side walls 36 are also identified.

Parallel spaced apart side walls 36 normal to the axial bore 26 connect the transitional arcuate surfaces 34 and 54 with the axial bore 26 of the wheel 18. Parallel side walls 36 are also radially symmetrically disposed relative to the axial bore. The parallel side walls 36 are about 0.875 to about 0.99 inches apart, and preferably are about 0.945 inches apart. The invention anticipates that several arcs having different radii may comprise each of the first and second transitional arcuate surface 34 and 54 which connect the first arcuate perimeter surface 32 to the parallel sidewalls 36. Parallel side walls 36 may extend for identical lengths, or the lengths of the side walls 36 may be different lengths.

The wheel 18 of the invention preferably has a radius which is suitable for in-line roller skates. Currently, in-line skates accept wheels having radii of about 1.4 to about 1.5 inches. However, as in-line skate manufacturers develop new skates one skilled in the art will recognize that the overall size of the wheel may change, however, the overall shape of the wheel of the present invention may still be practiced.

The above-described wheel shape allows an in-line skater to increase his/her speed without greatly increasing the effort placed into each lateral push during acceleration. In other words, the efficiency of the skater is increased with skates having the wheel of the present invention. Without intending to be bound by theory, it is believed that the reason for this is two-fold. First, the first arcuate perimeter surface of the wheel contacts the pavement when the wheel axis is parallel to the ground. The wheel is in this upright position while a skater is coasting and no camber is present. Since the wheel of the present invention has a reduced surface area contacting the pavement when the wheel is in the upright position, the wheel provides less drag or friction against the pavement. This allows the wheels to rotate more easily and thereby allows the skater to coast faster than on skates containing hemispherical-shaped prior art wheels.

The second reason why the wheel shape of the present invention provides increased speed without increased effort lies in the shape of the transitional arcuate surfaces. An in-line skater accelerates by laterally pushing the skates away from his/her body against the pavement. As earlier described, this causes the skate wheels to tilt and this in turn causes the surface on the wheel contacting the pavement to change. During this lateral pushing the transitional arcuate surface contacts the pavement. Due to the large radii of the transitional arcuate surfaces, an increased surface area contacts the pavement during acceleration as compared to during coasting. On first blush one might believe that the increased surface area of the wheel contacting the pavement would serve to slow a skater, however, this is not true. An increased wheel surface area contacting the pavement during acceleration provides an increased gripping surface. This allows the wheel to better contact the pavement and provides more friction against the pavement. The skater is thus able to get more forward thrust from each lateral push without increasing his/her effort.

Although arcs of circles are used to describe the present invention, one skilled in the art will recognize that numerous other geometric shapes could potentially be used to describe the invention. The cross sectional shape as shown in FIG. 6 of the tread 20 of the present invention approaches the shape of a parabola. Portions of a parabola or of an ellipse could also be used to describe the wheel shape. To this end, one skilled in the art will recognize that details of the previous embodiment may be varied without departing from the spirit and scope of the invention.

We claim:

1. An in-line skate wheel, comprising:

a radially symmetrical body, said body defined in cross section by:

an axial bore surface, a first convex arcuate perimeter surface having a constant radius subsuming less than a 180 degree angle and having a first edge and a second edge wherein said first arcuate surface is radially disposed concentric to said axial bore, at least one first convex transitional arcuate surface having a constant radius greater than said radius of said first arcuate perimeter surface and tangentially connecting to said perimeter surface at said first edge and radially disposed to said axial bore, at least one second convex transitional arcuate surface having a constant radius greater than said radius of said first arcuate perimeter surface radius, said second convex transitional arcuate surface tangentially connecting to said perimeter surface at said second edge and radially symmetrically disposed relative to said axial bore, a pair of spaced apart parallel sidewalls normal to said axial bore and each connecting to one of said first or second transitional arcuate surfaces to said axial bore surface and radially symmetrically disposed relative to said axial bore.

2. The wheel of claim 1 wherein said first and second transitional arcuate surfaces are bilaterally symmetrical with respect to a plane perpendicular to said axial bore.

3. The wheel of claim 1 wherein said first and second transitional arcuate surfaces have different radii.

4. The wheel of claim 1 wherein said first and second transitional arcuate surfaces are each at least 2.5 times greater than the radii of said first arcuate perimeter surface.

5. The wheel of claim 1 wherein said radius of said first arcuate perimeter surface is about 0.28 to about 0.36 inches.

6. The wheel of claim 1 wherein said first arcuate perimeter surface and said transitional arcuate surfaces create a smoothly sloping periphery of said wheel.

7. The wheel of claim 1 having a plurality of first and second transitional arcuate surfaces.

8. The wheel of claim 1 wherein said parallel sidewalls are about 0.875 to about 0.99 inches apart.

9. The wheel of claim 1 wherein said first arcuate perimeter surface subsumes less than 180°.

10. The wheel of claim 1 wherein said first arcuate perimeter surface subsumes between 72° to about 79°.

11. The wheel of claim 4 wherein said radii of said transitional arcuate surfaces are each about 0.85 to about 0.92 inches.

12. An in-line skate wheel, comprising:

a radially symmetrical body, said body defined in cross section by:

an axial bore surface, a first convex arcuate perimeter surface having a content radius subsuming less than a 180° degree angle and having a first edge and a second edge wherein said first arcuate surface is radially disposed concentric to said axial bore, a first convex transitional arcuate surface having a constant radius greater than said first arcuate perimeter surface radius and tangentially connecting to said perimeter surface at said first edge and radially disposed to said axial bore, a second convex transitional arcuate surface having a constant radius greater than said first arcuate perimeter surface radius, said second convex transitional arcuate surface tangentially connecting to said perimeter surface at said second edge and radially symmetrically disposed relative to said axial bore, a pair of spaced apart parallel sidewalls normal to said axial bore connecting said transitional arcuate surfaces to said axial bore surface and radially symmetrically disposed relative to said axial bore.

* * * * *